US010890410B1

(12) United States Patent
Major

(10) Patent No.: US 10,890,410 B1
(45) Date of Patent: Jan. 12, 2021

(54) BODILESS DOUBLE AND SINGLE CALIPER ARCHERY RELEASE

(71) Applicant: BERRY MTN., INC., Liverpool, PA (US)

(72) Inventor: Jarrod Burk Major, Liverpool, PA (US)

(73) Assignee: Berry Mtn., Inc., Liverpool, PA (US)

( * ) Notice: Subject to any disclaimer, the term of this patent is extended or adjusted under 35 U.S.C. 154(b) by 0 days.

(21) Appl. No.: 16/859,303

(22) Filed: Apr. 27, 2020

Related U.S. Application Data

(60) Provisional application No. 62/838,349, filed on Apr. 25, 2019.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 4,036,204 A * 7/1977 Scott ..... F41B 5/1469 124/35.2
4,160,437 A * 7/1979 Fletcher ..... F41B 5/1469 124/35.2
4,282,851 A * 8/1981 Lyons ..... F41B 5/1469 124/35.2
5,170,771 A * 12/1992 Peck ..... F41B 5/1469 124/35.2
5,370,102 A * 12/1994 Peck ..... F41B 5/1469 124/35.2
5,941,225 A * 8/1999 Tentler ..... F41B 5/1469 124/35.2
8,276,575 B1 * 10/2012 Gillig ..... F41B 5/1469 124/35.2

* cited by examiner

*Primary Examiner* — John A Ricci
(74) *Attorney, Agent, or Firm* — Hooker & Habib, P.C.

(57) ABSTRACT

An index-finger trigger-type archery release includes a bodiless release head having a pair of calipers movably connected with another that extend from an upper end of the release head and at least one of the calipers extends to the lower end of the release head. A trigger operatively connected to the calipers enables the release head to be placed into an opened position from a closed position. The calipers can be pressed together to place the release head back into the closed position.

31 Claims, 8 Drawing Sheets

BODILESS DOUBLE AND SINGLE CALIPER ARCHERY RELEASE

RELATED APPLICATION

This application claims the benefit of and priority to U.S. Patent Application Ser. No. 62/838,349 "Bodiless Double and Single Caliper Archery Release" filed Apr. 25, 2020, which priority application is incorporated by reference as if fully set forth herein.

FIELD OF THE DISCLOSURE

The disclosure relates generally to an archery release used for releasing an arrow from a bowstring, and in particular to an index finger trigger-type archery release.

BACKGROUND OF THE DISCLOSURE

Archery releases have a release head that holds a bowstring while an archer is pulling on the release to draw the bowstring. The archery release enables the archer to smoothly and consistently draw back the bowstring and release the bowstring for consistent and repeatable arrow flight.

A trigger-type archery release includes a release head having a body, with an exposed trigger and exposed jaws or calipers extending from the body, and a release mechanism operatively connecting the trigger to the calipers. Pulling the trigger causes the release mechanism to move one or both calipers movably connected to the release head, placing the release head in an open position with the caliper(s) able to receive the bowstring into the archery release or to release an attached bowstring from the archery release.

An index finger trigger-type archery release is configured to trigger the jaws by the archer pulling on the trigger with the archer's index finger.

Manufacturers of index finger trigger-type archery releases use different types of release mechanisms to actuate the hook or jaw in response to movement of the trigger.

It is desirable to provide a more simplified construction of a release mechanism for an index finger trigger-type archery release for better reliability, smoother operation, and lower cost.

SUMMARY OF THE DISCLOSURE

Disclosed is an index finger trigger-type archery release having a simplified construction of a release mechanism that does not require a body. The release mechanism also makes it easier to attach the bow string and/or what is known as the "d-loop" to the archery release. The d-loop is the standard typical practice of what is used to connect a release to draw a bow.

The disclosed archery release removes the body of from the release to form a bodiless release. The archery release joins the two calipers together at the rear of the calipers. This reduces parts and removes the need for positioning the two calipers inside another part. By eliminating the body of a conventional index finger trigger-type archery release, the disclosed release looks dramatically different than the standard bodied archery release and is easier and more convenient to use.

1. An archery release in accordance with the disclosure includes a first caliper and second caliper, each caliper having an end portion located at a first end of the archery release. The first and second calipers are pivotally mounted for relative pivotal movement of the calipers towards and away from each other about a common first pivot axis.

The calipers are pivotally movable towards one another to a closed position of the calipers where the first and second caliper end portions are adjacent one another, and the calipers are pivotally movable away from one another from the closed position to an opened position of the calipers where the first and second caliper end portions are spaced apart from one another and define a gap between them.

A trigger is pivotally mounted to one of the first and second calipers, the trigger being movable to and from a raised position and a lowered position pivotally spaced from the raised position.

A stop member is connected to the trigger, the stop member being conjointly movable with the trigger moving between the raised and lowered positions of the trigger.

When the calipers are in the closed position and the trigger is in the raised position, the stop member is in the path of pivotal movement of the second caliper away from the first caliper and the stop member generates a force applied to the second caliper resisting further pivotal movement of the second caliper away from the first caliper. When the calipers are in the opened position and the trigger is in the lowered position, the stop member is in the path of pivotal movement of the second caliper away from the first caliper and the stop member generates a force applied to the second caliper resisting further pivotal movement of the second caliper away from the first caliper.

The disclosed archery release is disclosed in multiple designs or embodiments. A first set of embodiments is for a double caliper release. A second set of embodiments is for a single caliper release.

The disclosed archery release can utilize different types of release mechanisms. The sets of embodiments utilize an "over-the-center" type of release mechanism. One set of embodiments include the stop member being formed as part of the trigger. Another utilize a linkage design in which the stop member is a separate member from the trigger, the stop member and trigger cooperatively forming a linkage mechanism.

The disclosed archery release enables the archer to much easier connect the archery release to the bow to shoot the bow.

A typical standard practice to connect a release to a bowstring is to have the archer pull the trigger back, placing the release head in the open position. After receiving the bowstring into the release head, the archer pushes the trigger forward, placing the release head in the closed position and the caliper(s) holding the bowstring in the release head. Another standard practice is to pull on the trigger to open the release head and to release the pulled trigger to close the release head.

The disclosed archery release on the other hand is a "pinch-to-close" connection, making it much easier to address the bowstring. The caliper(s) remain open after pulling the trigger if the archer releases the trigger, Once the bowstring is received into the release head, it is not necessary for the archer to push the trigger. The archer pinches the caliper(s) which then locks the release head in the closed position to hold the bowstring. This type of function is a natural type of action and acts as an extension of the archer's fingers. An example of this would be the way tweezers are used. The disclosed archery release is particularly suitable for youth archers with limited dexterity.

The disclosed archery release reduces parts needed and creates a simpler functioning and user friendly index trigger activated archery release.

Other objects and features of the disclosure will become apparent as the description proceeds, especially when taken in conjunction with the accompanying drawing sheets illustrating one or more illustrative embodiments.

DETAILED DESCRIPTION

Figure 1:
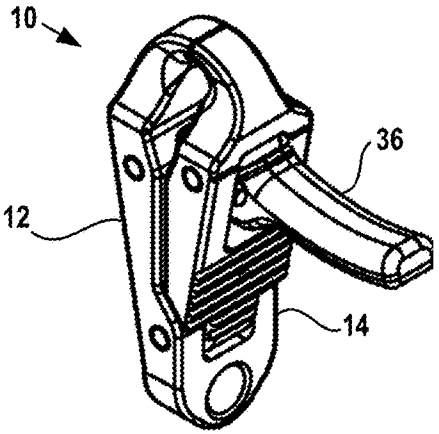
FIG. 1 is a perspective view of a first embodiment release head of a double-caliper archery release, the calipers in a closed position.
Figure 2:
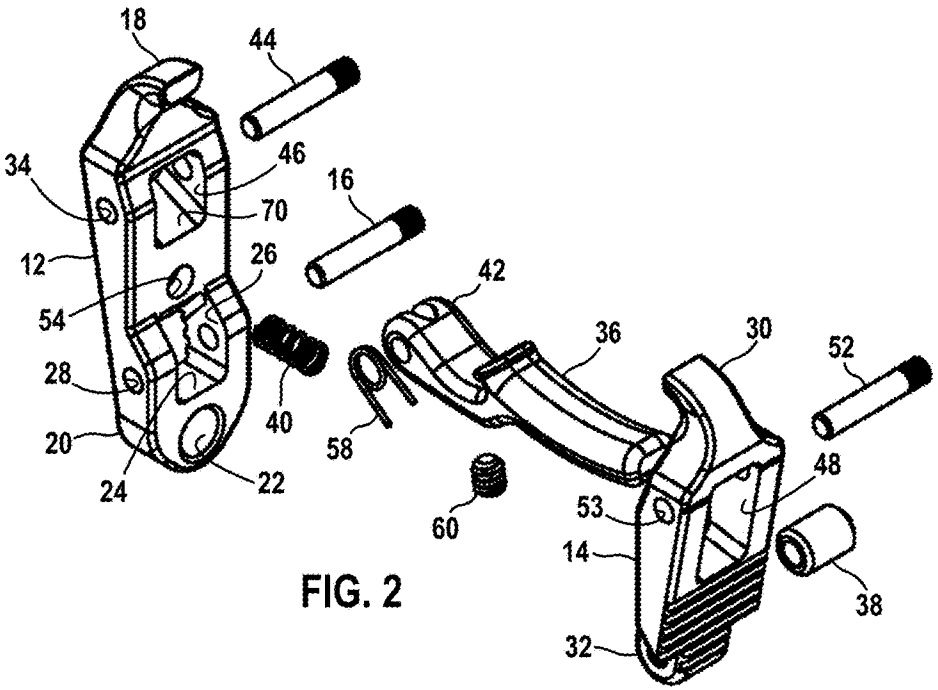
FIG. 2 is an exploded view of the release head shown in FIG. 1.

FIGS. 1-4 illustrate a release head 10 of a first embodiment double-caliper index finger trigger-type archery release. The release head 10 employs a roller-type release mechanism.

The archery release 10 includes a first and larger caliper and a second and smaller caliper 14. The large and small calipers are mounted for pivotal movement on a first pivot pin 16 defining a common pivot axis. The calipers pivot towards and away from each other between an opened position of the release head shown in FIG. 3 and a closed position of the release head shown in FIGS. 1 and 4. The outer surfaces of the calipers may include a slip-resistant surface or slip-resistant surface structure (such as including grooved surfaces as illustrated in the figures) if desired.

The larger caliper 12 extends from an upper curved retention finger 18 to a lower end portion 20. The lower end portion forms the lower end of the release head 10 and is a relatively thick portion of the larger caliper. The lower end portion includes a through-hole 22 for receiving a lanyard or the like and a recess 24 spaced above the through-hole 22. The recess 24 opens into the lower end portion and is bounded by opposing side walls 26, Lateral through hole 28 extends through the side holes to receive the pivot pin 16.

The smaller caliper 14 extends from an upper curved retention finger 30 to a reduced-thickness lower end portion or plug 32. The lower end portion includes a lateral through-hole 34 to receive the pivot pin 16. The plug 32 of the smaller caliper 14 is received in the recess 24 and is pivotally mounted to the larger caliper 14 by the pivot pin 16 extending through the aligned lateral through-holes 28, 34.

The release head 10 includes a release mechanism that enables the archer to selectively place the release head in opened and closed positions. The release mechanism includes a trigger 36 pivotally mounted on the large caliper 12, a roller 38 rotatably mounted on the smaller caliper 14, and a compression spring 40 captured between the calipers that urges the calipers apart from one another.

In other embodiments the trigger can be mounted on the small caliper and the roller on the large caliper.

The trigger 38 includes an end portion 42 formed as clevis that receives a second pivot pin 44 that pivotally mounts the trigger to the large caliper 12. The release mechanism includes a recess 46 formed in the large caliper 13 that receives the clevis and carries the trigger pivot pin 44. The trigger extends from the large caliper, through a rectangular through-hole 48 in the small caliper 12, and to a free end portion 50 configured to be pulled by an index finger of an archer. The trigger can pivot relative to the larger caliper 14 from a first, raised trigger position shown in FIG. 4 corresponding to the release head being in a closed position to a second, lowered trigger position shown in FIG. 5 corresponding to the release head being in an opened position.

The roller 38 is mounted for rotation in the small caliper opening 48 on a third pin 52 received in the through-hole 53 that rotatably mounts the roller to the small caliper. The roller is disposed to define the raised trigger position and resist further pivotal movement of the trigger away from the lowered trigger position.

The release mechanism further includes a pair of blind holes 54, 56 disposed in the large caliper 12 and the small caliper 14 respectively, a torsion spring 58, and a set screw 60. The blind holes cooperate to hold and capture the compression spring 40 whereby the compression spring urges the calipers to pivot away from each other about the pivot pin 16, that is, the compression urges the release head 10 to its opened position.

The torsion spring 58 is mounted on the second pivot pin 44. The legs of the torsion spring act to urge the trigger 38 towards its raised position. The set screw 60 is received in a threaded set screw hole 62 formed in the trigger 38 that is aligned with the roller 40. The set screw's position can be threadably adjusted such that the set screw can engage the roller to enable the archer to adjustably place the raised position of the trigger in the most comfortable position for the archer.

Figure 3:
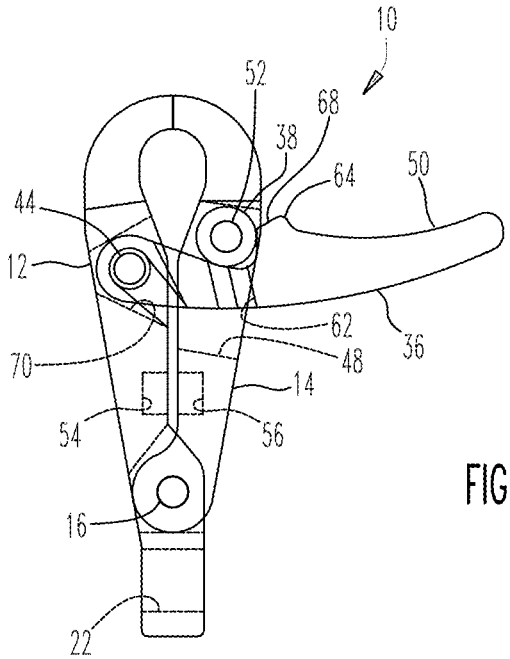
FIGS. 3 and 4 are front views of the release head shown in FIG. 1 in the closed and opened positions respectively.
Figure 4:
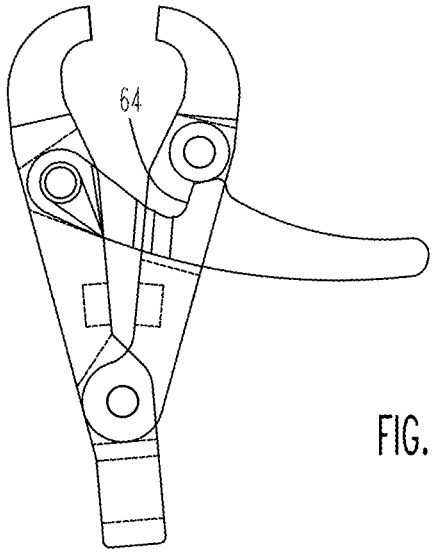

FIG. 3 illustrates the release head 10 in the closed position and FIG. 4 illustrates the release head in the opened position (to simplify the drawings, FIGS. 3 and 4 do not illustrate the springs or set screw. The drawings are drawn showing the internal components of the release head to clarify operation of the release mechanism.

As shown in the figures, the release head 10 does not include a body that holds or mounts the calipers 12, 14. The calipers are formed as separate members, with the larger caliper 12 holding the pivot pin 16 that attaches the small caliper 14 to the large caliper without need of a body. The ends of the pins extending through the caliper or calipers may be exposed and visible to the archer. The springs and roller of the release mechanism are held by the upper and lower calipers without need of a body (and in release mechanisms having linkage-type release mechanism described below, the link(s) are connected to the calipers without need of a body). The lower caliper extends to the opposite second end of the release head and includes the through-hole 22 for receiving a lanyard without the need of a body. The front sides of the calipers shown in FIGS. 3 and 4 and the opposite back sides of the calipers cooperated to form the front and back sides of the release head 10.

The release mechanism further includes a cam 64 defining a first cam surface 66 on the side of the cam extending away from the trigger surface and facing the roller, and a second cam surface 68 on the top of the cam. As shown in FIG. 3, when the trigger 36 is in its raised position the first cam surface is in the path of conjoint pivotal movement of the roller 38 with the smaller caliper pivoting away from the larger caliper. The compression spring 40 urges the roller against the cam first surface to limit and resist further relative pivoting of the calipers away from each other. The torsion spring maintains the trigger pressing against the roller. The release head 10 is "locked" or held in the closed position without the archer pressing on the trigger.

FIG. 4 illustrates the release head 10 after the trigger 36 has been pulled by the archer. The trigger pivots about the trigger pivot pin 44 towards its lowered trigger position, moving the cam 64 out of the path of movement of the roller 38. The roller moves away from the large caliper 12 with conjoint pivotal movement of the smaller caliper 14 away from the large caliper. The pair of large and small caliper retention fingers 18, 30 move apart from one another defining a gap that can receive the bowstring into the release head or release a bowstring held in the release head.

Further pivotal displacement of the trigger past its lowered trigger position is resisted by the trigger moving against the sloped floor 70 of the large caliper recess 46. In the lowered trigger position the roller 38 engages the second cam surface 68 and resists upward pivotal movement of the trigger urged by the torsion spring 58. The release head is "locked" or held in the opened position without the archer pressing on the trigger.

To close the opened release head 10, the archer pinches the calipers 12, 14 together to bring the caliper retention fingers 18, 30 back together, eliminating the gap between them. Movement of the roller 38 away from the second cam surface 68 enables the torsion spring 58 to urge the trigger 36 back to its raised position, thereby placing the first cam surface 66 back into the path of pivotal movement of the roller away from the large caliper. The release head 10 is again "locked" or held in the closed position without the archer pressing on the trigger.

FIGS. 5, 5A, 5B, and 6-8 are similar to FIGS. 3 and 4 in illustrating other embodiments of the disclosed archery release utilizing other release mechanisms. Only the differences in release mechanisms will be discussed as the calipers in these embodiments are similar to the calipers 12, 14 of the release head 10.

FIGS. 5, 5A, 5B, and 6 illustrate a second embodiment release head 110.

The second embodiment release head utilizes a linkage-type release mechanism. The trigger 36 is pivotally mounted to the small caliper 14, the trigger pivotally mounted on the pin 52 by an enlarged collar 114. The trigger extends from the collar, through the small caliper through-hole 48 and to a free end portion 50 similar in shape and relative position to the small caliper as the free end portion of the trigger of the release head 10.

The release mechanism includes a link 114 pivotally attached to the trigger 36 and to the large caliper 12. The link is pivotally attached to the trigger by a pivot pin 116 spaced from the pivot pin 52 in the direction away from the large caliper. The link is pivotally attached to the pivot pin 44 carried by the large caliper 12. The pivot pins extend through holes in the link. The set screw hole 62 is located in the link instead of the trigger.

The compression spring (not shown) captured in the caliper blind holes 54, 56 urge the calipers 12, 14 to pivot apart. The torsion spring (not shown) mounted on the pivot pin 44 urges the link to pivot in the counter-clockwise direction about the pivot pin as viewed in FIG. 5.

Figure 5:
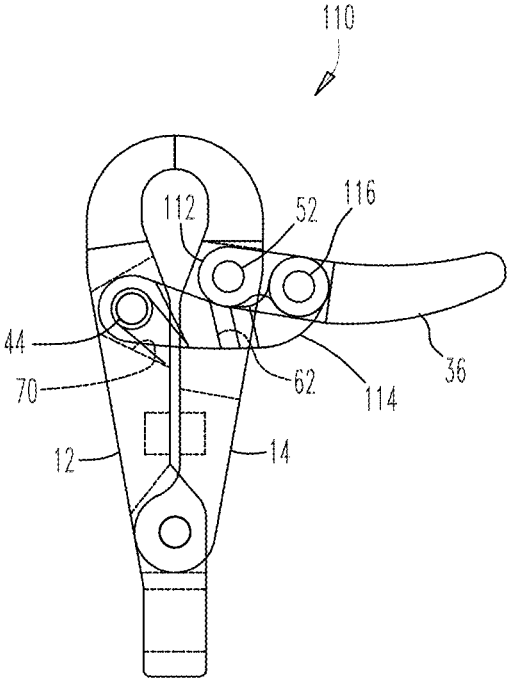
FIGS. 5 and 6 are front views of a second embodiment release head of a double-caliper archery release in the closed and opened positions respectively.

FIG. 5 illustrates the release head 110 in its closed position. The link 114 is pressed against the collar 112 of the trigger 36 and has thereby placed the trigger in its raised position. The calipers cannot pivot away from each other due to the fixed distance between the holes of the link. The release head 110 is locked or held in the closed position without the archer pressing on the trigger.

Figure 6:
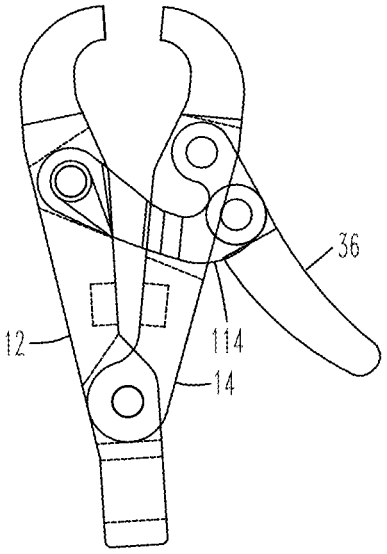
Figure 5B:
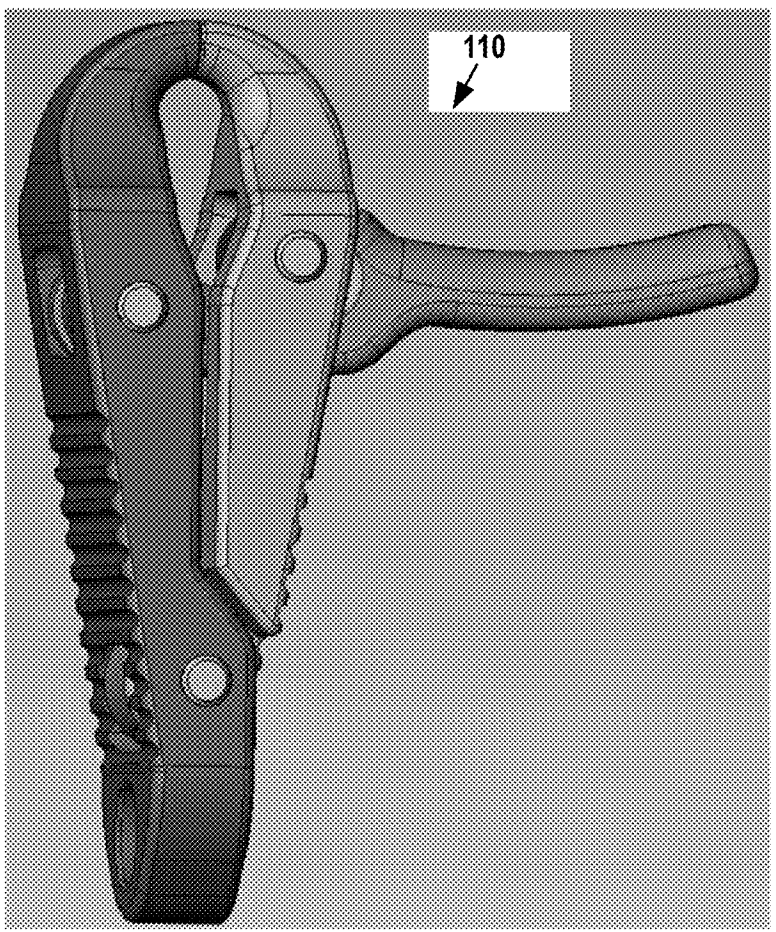
FIGS. 5A and 5B are similar to FIG. 5 but are front and side/back views of the second embodiment release head.
Figure 5A:
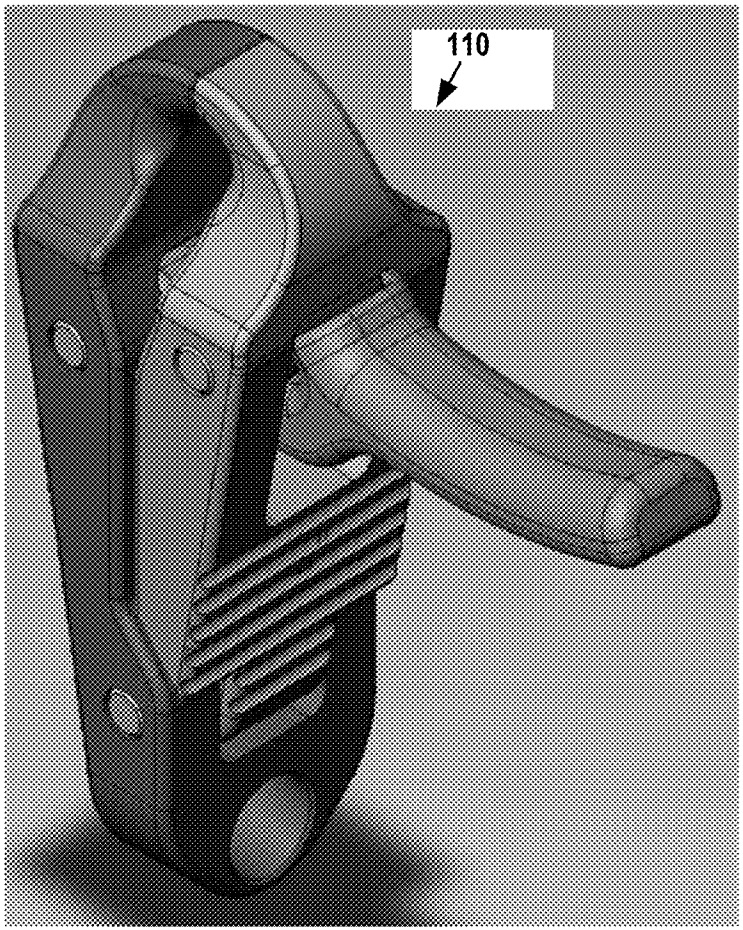

FIG. 6 illustrates the release head 110 after the trigger 36 has been pulled by the archer. The trigger pivots about the pivot pin 52 (the pin 52 functioning as a pivot pin rather than a roller pin in this embodiment) towards its lowered trigger position, thereby revolving the pivot pin 116 clockwise as viewed in FIG. 6 about the pivot pin 53. Angular displacement of the pivot pin 116 causes the link 114 to pivot and rotate about the pivot pin 44 in a counterclockwise direction in FIG. 6, until the link 114 abuts against the sloped floor 70 of the large caliper, thereby defining the lowered position of the trigger.

In the lowered trigger position the torsion spring cannot transmit sufficient torque through the link and to the pivot pin 116 to overcome and compress the compression spring 40 to pivot the smaller caliper 14 towards the large caliper 12. The release head 110 is locked or held in the closed position without the archer pressing on the trigger.

To close the opened release head 110, the archer pinches the calipers 12, 14 together to bring the caliper retention fingers 18, 30 back together, eliminating the gap between them. Pivotal movement of the calipers towards each other cause the link 114 to pivot and rotate in the clockwise direction about the pivot pin 44 and the trigger to pivot and rotate in the clockwise direction about the pivot pin 52 as viewed in FIG. 6 until the link engages the trigger collar 114, placing the release head back to its closed position. The release head 110 is again locked or held in the closed position without the archer pressing on the trigger.

Figure 7:
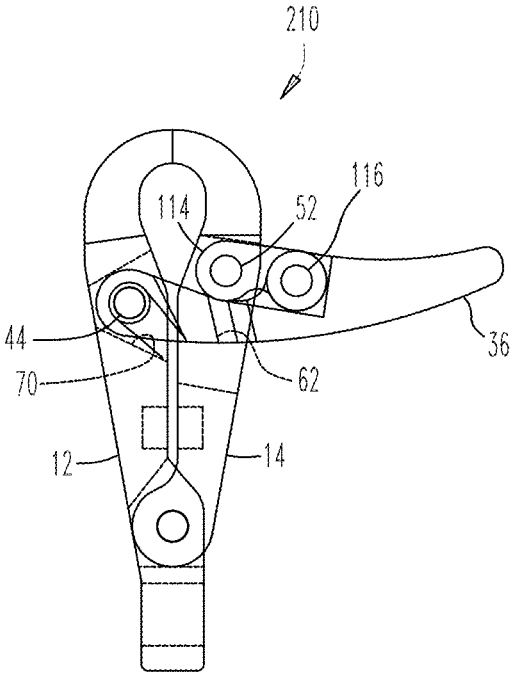
FIGS. 7 and 8 are front views of a third embodiment release head of a double-caliper archery release in the closed and opened positions respectively.
Figure 8:
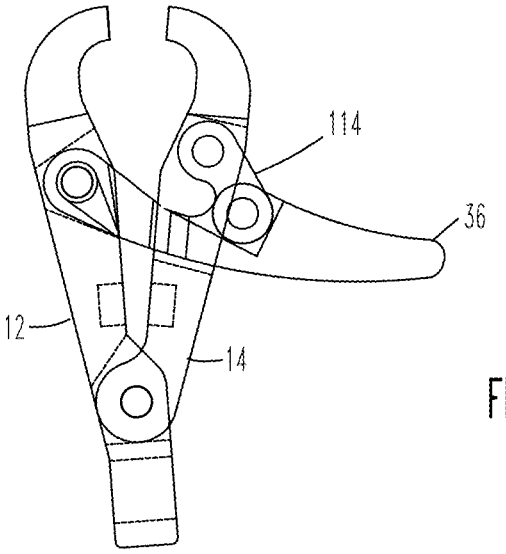

FIGS. 7 and 8 illustrate a third embodiment release head 210.

The third embodiment release head 210 also utilizes a linkage-type release mechanism. The trigger 36 is pivotally mounted to the large caliper 12, the trigger being pivotally mounted on the pivot pin 44. The trigger is similar to the trigger of the release head 10 and extends from the pivot pin, through the small caliper through-hole 48 and to a free end portion 50. The set screw hole 62 is located in the trigger.

The release mechanism includes a link 114 pivotally attached to the trigger 36 and to the small caliper 15. The link is pivotally attached to the small caliper by the pivot pin 52. The link is pivotally connected to the trigger by the pivot pin 116 spaced from the pivot pin 52 in the direction away from the large caliper.

The compression spring (not shown) captured in the caliper blind holes 54, 56 urge the calipers 12, 14 to pivot apart. The torsion spring (not shown) mounted on the pivot pin 44 urges the trigger 36 to pivot in the counter-clockwise direction about the pivot pin 44 as viewed in FIG. 7.

FIG. 7 illustrates the release head 210 in its closed position. The trigger 36 is pressed by the torsion spring against the pivot pin 52 through the link 114. The link is rotated to the position shown in the figure. The calipers 12, 14 cannot pivot away from each other due to the fixed distance between the holes carrying the pivot pins attached to the trigger. The release head 210 is locked or held in the closed position without the archer pressing on the trigger.

FIG. 8 illustrates the release head 210 after the trigger 36 has been pulled by the archer. The trigger pivots about the pivot pin 44 towards its lowered trigger position, thereby revolving the pivot pin 116 clockwise as viewed in FIG. 6 about the pivot pin 52 until the trigger abuts against the sloped floor 70 of the large caliper, thereby defining the lowered position of the trigger. Angular displacement of the pivot pin 116 causes the link 114 to pivot and rotate about the pivot pin 52 in a clockwise direction as viewed in FIG. 6, and enabling the calipers 12, 14 to move apart from each other.

In the lowered trigger position the torsion spring cannot transmit sufficient torque to the trigger 36 to overcome and compress the compression spring 40 to pivot the smaller caliper 14 towards the large caliper 12. The release head 210 is locked or held in the closed position without the archer pressing on the trigger.

To close the opened release head 210, the archer pinches the calipers 12, 14 together to bring the caliper retention fingers 18, 30 back together, eliminating the gap between them. Pivotal movement of the calipers towards each other cause the link 114 to pivot and rotate in the clockwise direction about the pivot pin 52 and the trigger to pivot and rotate in the clockwise direction about the pivot pin 44 as viewed in FIG. 8 until the trigger effectively presses against the pivot pin 52, placing the release head back to its closed position. The release head 210 is again locked or held in the closed position without the archer pressing on the trigger.

Figure 9:
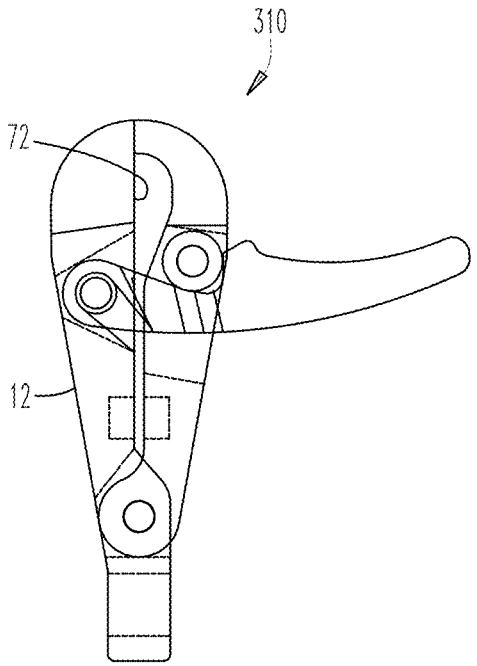
FIGS. 9 and 10 are front views of a fourth embodiment release head of a single-caliper archery release in the closed and opened positions respectively.
Figure 10:
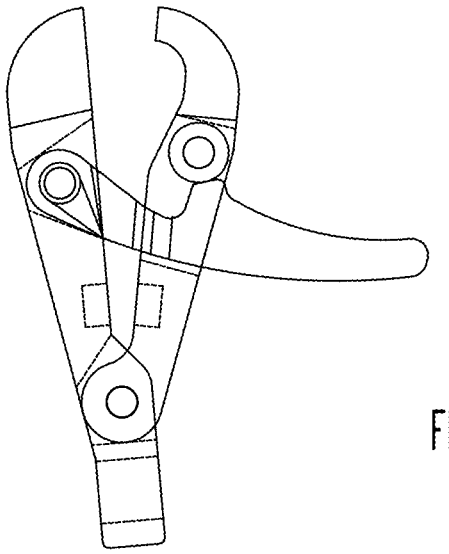
Figure 11:
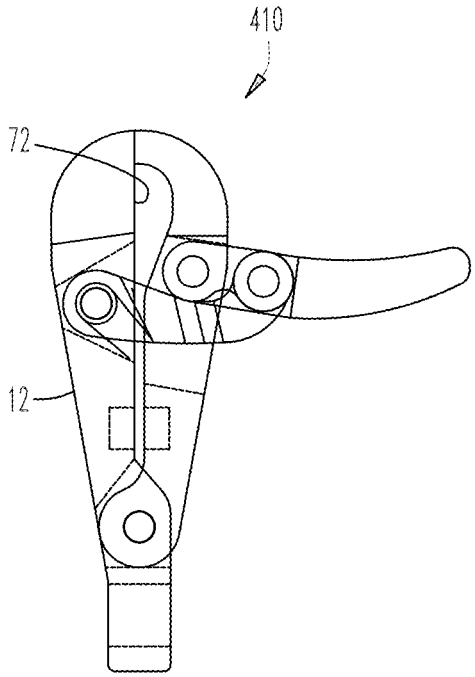
FIGS. 11 and 12 are front views of a fifth embodiment release head of a single-caliper archery release in the closed and opened positions respectively.
Figure 12:
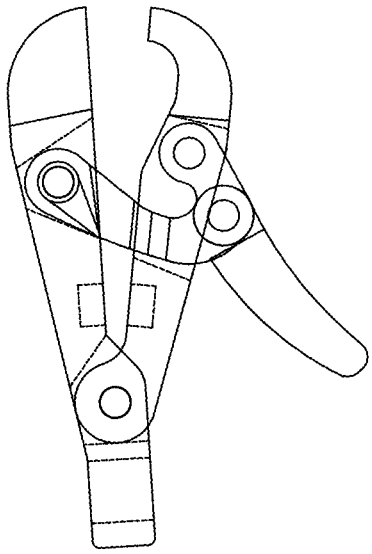
Figure 13:
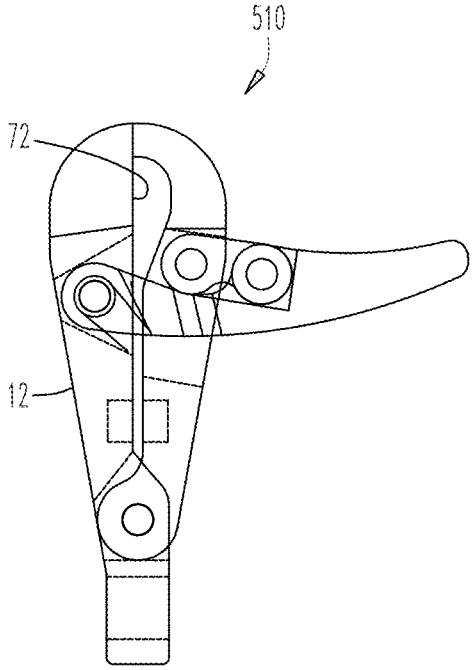
FIGS. 13 and 14 are front views of a sixth embodiment release head of a single-caliper archery release in the closed and opened positions respectively.
Figure 14:
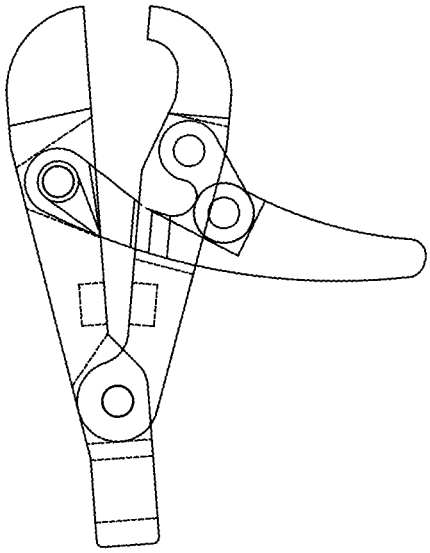

FIGS. 9 and 10 illustrate a fourth embodiment release head 310 similar to the release head 10, FIGS. 11 and 12 illustrate a fifth embodiment release head 410 similar to the release head 110, and FIGS. 11 and 13 illustrate a sixth embodiment release head 510 similar to the release head 210. The release heads 310, 410, 510 are "single-caliper" release heads while their corresponding release heads 10, 110, 210 respectively are "double caliper" release heads. In the double-caliper release heads both calipers 12, 14 include retention fingers that cooperate to retain the bowstring in the release head. In the single-caliper release heads the retention finger of the large caliper 12 is eliminated and replaced with an upper end portion of the large caliper 12 having a flat surface 72 facing the retention finger 30 of the small caliper 12.

Features of the disclosed archery release may include (and are not limited to) the following features or combinations of the features:

Feature 1. An archery release including:

a first caliper including an end portion;

a second caliper including an end portion;

the first and second calipers being pivotally mounted for relative pivotal movement of the calipers towards and away from each other about a common first pivot axis, the calipers being pivotally movable towards one another to a closed position of the calipers wherein the first and second caliper end portions are adjacent one another, and the calipers being pivotally movable away from one another from the closed position to an opened position of the calipers wherein the first and second caliper end portions are spaced apart from one another and define a gap therebetween;

a trigger pivotally mounted to one of the first and second calipers, the trigger being movable to and from a raised position and a lowered position pivotally spaced from the raised position;

a stop member being connected to the trigger, the stop member being conjointly movable with the trigger moving between the raised and lowered positions of the trigger;

wherein when the calipers are in the closed position and the trigger is in the raised position, the stop member is in the path of pivotal movement of the second caliper away from the first caliper and the stop member being disposed to generate a force applied to the second caliper resisting further pivotal movement of the second caliper away from the first caliper; and wherein when the calipers are in the opened position and the trigger is sin the lowered position, the stop member is in the path of pivotal movement of the second caliper away from the first caliper and the stop member being disposed to generate a force applied to the second caliper resisting further pivotal movement of the second caliper away from the first caliper.

Feature 2. The archery release of feature 1 including a spring being disposed to generate a force being transmitted to the trigger urging the trigger towards the raised position of the trigger.

Feature 3. The archery release of feature 1 including a spring being disposed between the first and second calipers, the spring being disposed to generate a force being transmitted to the calipers urging pivotal movement of the first and second calipers towards the opened position of the calipers.

Feature 4. The archery release of feature 1 including a first end and an axially opposite second end, the first end portions of the calipers being disposed at the first end of the archery release and at least one of the calipers extending continuously from the first end of the archery release to the second end of the archery release.

Feature 5. The archery release of feature 4 wherein only one of the first and second calipers extends from the first end of the archery release to the second end of the archery release.

Feature 6. The archery release of feature 5 wherein the only one of the first and second calipers comprises a recess and the other caliper extends from the first end of the archery release to an opposite second end being disposed in the recess.

Feature 7. The archery release of feature 1 wherein the first and second calipers are movable towards one another from the opened position to the closed position whereby an archer can squeeze the calipers together to manually move the calipers from the opened position to the closed position.

Feature 8. The archery release of feature 7 including a spring being disposed to generate a force transmitted to the trigger urging the trigger towards the raised position of the trigger;

wherein movement of the calipers from the opened position to the closed position causes the force generated by the spring to move the trigger from the lowered position to the raised position as the calipers move from the opened position to the closed position, thereby enabling the calipers to be locked in the closed position in response to the archer moving the calipers from the opened position to the locked position.

Feature 9. The archery release of feature 1 wherein the first and second calipers as a unit are not housed within a body and are not housed partially within a body.

Feature 10. The archery release of feature 1 wherein the end portions of the calipers are disposed at a first end of the archery release, and the trigger pivots about a second pivot axis, the second pivot axis being disposed between the front end of the archery release and the first pivot axis.

Feature 11. The archery release of feature 1 wherein the stop member forms a portion of the trigger, the trigger being pivotally mounted to the first caliper for pivotal movement of the trigger between the raised and lowered positions of the trigger.

Feature 12. The archery release of feature 11 wherein the trigger extends from the first caliper and through an opening in the second caliper.

Feature 13. The archery release of feature 12 including a body mounted in the opening and attached to the second caliper, the body abutting the stop member when the calipers are in the opened position and the trigger is in the lowered position to resist further movement of the second caliper away from the first caliper.

Feature 14. The archery release of feature 13 wherein the stop member comprises spaced apart first and second surfaces, when the calipers are in the opened position and the trigger is in the lowered position the body abuts the first surface to resist further movement of the second caliper away from the first caliper, and when the calipers are in the closed position and the trigger is in the raised position the body abuts the second surface to resist further movement of the second caliper away from the first caliper.

Feature 15. The archery release of feature 11 wherein the first caliper is disposed in the path of pivotal movement of the trigger from the raised position to the lowered position of the trigger, the first caliper engaging the trigger when the trigger is in the lowered position, the first caliper resisting further pivotal movement of the trigger past the lowered position of the trigger and thereby defining the lowered position of the trigger.

Feature 16. The archery release of feature 11 wherein the first and second calipers are movable towards one another from the opened position to the closed position whereby an archer can squeeze the calipers together to manually move the calipers from the opened position to the closed position.

Feature 17. The archery release of feature 16 including a first spring being disposed to generate a force transmitted to the trigger urging the trigger towards the raised position of the trigger;

wherein movement of the calipers from the opened position to the closed position causes the force generated by the first spring to move the trigger from the lowered position to the raised position as the calipers move from the opened position to the closed position and thereby enabling the calipers to be locked in the closed position in response to the archer moving the calipers from the opened position to the closed position.

Feature 18. The archery release of feature 11 including a second spring disposed between the first and second calipers, the second spring being disposed to generate a force transmitted to the calipers urging pivotal movement of the first and second calipers towards the opened position of the calipers.

Feature 19. The archery release of feature 18 wherein the second spring is disposed between the first pivot axis and the first end portions of the calipers.

Feature 20. The archery release of feature 11 including a first spring, a second spring, a roller, a first end, and an opposite second end;

the first and second calipers as a unit are not disposed in a body and are not partially disposed in a body;

the first spring is a torsion spring disposed to generate a torque applied directly by the first spring to the trigger urging the trigger towards the raised position of the trigger;

the second spring is a compression spring disposed between the first and second calipers and is disposed to generate a force transmitted to the calipers urging pivotal movement of the first and second calipers towards the opened position of the calipers;

the first end portions of the calipers are disposed at the first end of the archery release and the first caliper extends from the first end of the archery release to the second end of the archery release, the first pivot axis is disposed between the first and second ends of the archery release, and the second pivot axis is disposed between the first end of the archery release and the first pivot axis;

the first caliper extends from the first end of the archery release to an axially opposite second end of the archery release, the first caliper including a recess;

the second caliper extends from the first end portion to a second end portion, and the second end portion is received in the recess of the first caliper;

the trigger extends from the first caliper and through an opening in the second caliper, the roller is rotatably attached to the second caliper and is disposed in the opening;

the stop member comprises spaced apart first and second surfaces, when the calipers are in the opened position and the trigger is in the lowered position the roller abuts the first surface to resist further movement of the second caliper away from the first caliper, and when the calipers are in the closed position and the trigger is in the raised position the roller abuts the second surface to resist further movement of the second caliper away from the first caliper;

the first caliper is disposed in the path of pivotal movement of the trigger from the raised position to the lowered position of the trigger, the first caliper engaging the trigger when the trigger is in the lowered position, the first caliper resisting further pivotal movement of the trigger past the lowered position of the trigger and thereby defining the lowered position of the trigger;

the first and second calipers are movable towards one another from the opened position to the closed position whereby an archer can squeeze the calipers together to manually move the calipers from the opened position to the closed position; and movement of the calipers from the opened position to the closed position causes the force generated by the first spring to move the trigger from the lowered position to the raised position as the calipers move from the opened position to the closed position and thereby enabling the calipers to be locked in the closed position in response to the archer moving the calipers from the opened position to the closed position.

Feature 21. The archery release of feature 1 wherein the stop member and the trigger are separate members, the stop member being pivotally attached to the trigger for relative pivotal movement of the stop member with respect to the trigger about a second pivot axis and the stop member being pivotally attached to one of the first and second calipers for relative pivotal movement of the stop member with respect to the one of the first and second calipers about a third pivot axis.

Feature 22. The archery release of feature 21 wherein when the calipers are in the opened position and the trigger is in the lowered position the second caliper is disposed between the second pivot axis and the first caliper.

Feature 23. The archery release of feature 21 wherein when the calipers are in the closed position and the trigger is in the lowered position the second caliper is disposed between the second pivot axis and the first caliper.

Feature 24. The archery release of feature 21 including a spring generating a force applied directly by the spring to the stop member, the stop member transferring the force to the trigger, the force urging the trigger towards the raised position.

Feature 25. The archery release of feature 21 including a spring generating a force applied directly by the spring to the trigger, the force urging the trigger towards the raised position.

Feature 26. The archery release of feature 21 including a spring being disposed between the first and second calipers, the spring generating a force urging the calipers towards the open position of the calipers.

Feature 27. The archery release of feature 21 wherein the trigger is pivotally attached to the first caliper for pivotal movement about the second pivot axis and the one of the first and second calipers is the second caliper whereby the stop element is pivotally attached to the trigger and to the second caliper.

Feature 28. The archery release of feature 27 wherein the trigger extends from the first caliper and through an opening in the second caliper.

Feature 29. The archery release of feature 28 wherein the stop member extends from the third pivot axis out of the opening to the second pivot axis, the second caliper is disposed between the second pivot axis and the first caliper and the trigger abutting the stop member when the trigger is in the raised position, the stop member resisting further movement of the second caliper past the raised position of the trigger.

Feature 30. The archery release of feature 27 wherein the first caliper is disposed in the path of pivotal movement of the trigger from the raised position to the lowered position of the trigger, the first caliper engaging the trigger when the trigger is in the lowered position, the first caliper resisting further pivotal movement of the trigger past the lowered position of the trigger and thereby defining the lowered position of the trigger.

Feature 31. The archery release of feature 27 wherein the first and second calipers are movable towards one another from the opened position to the closed position whereby an archer can squeeze the calipers together to manually move the calipers from the opened position to the closed position.

Feature 32. The archery release of feature 31 including a spring being disposed to generate a force transmitted to the trigger urging the trigger towards the raised position of the trigger;

wherein movement of the calipers from the opened position to the closed position causes the force generated by the spring to move the trigger from the lowered position to the raised position as the calipers move from the opened position to the closed position and thereby enabling the calipers to be locked in the closed position in response to the archer moving the calipers from the opened position to the closed position.

Feature 33. The archery release of feature 27 including a spring generating a force applied by the spring directly to the trigger, the force urging the trigger towards the raised position.

Feature 34. The archery release of feature 27 including a spring disposed between the first and second calipers, the spring is disposed to generate a force transmitted to the calipers urging pivotal movement of the first and second calipers towards the opened position of the calipers.

Feature 35. The archery release of feature 34 wherein the spring is disposed between the first pivot axis and the first end portions of the calipers.

Feature 36. The archery release of feature 27 including a first spring, a second spring, a first end, and an opposite second end;

the first and second calipers as a unit are not disposed in a body and are not partially disposed in a body;

the first spring is a torsion spring disposed to generate a torque applied directly by the first spring to the trigger urging the trigger towards the raised position of the trigger;

the second spring is a compression spring disposed between the first and second calipers and is disposed to generate a force transmitted to the calipers urging pivotal movement of the first and second calipers towards the opened position of the calipers;

the first end portions of the calipers are disposed at the first end of the archery release and the first caliper extends from the first end of the archery release to the second end of the archery release, the first pivot axis is disposed between the first and second ends of the archery release, and the second pivot axis is disposed between the first end of the archery release and the first pivot axis;

the first caliper extends from the first end of the archery release to an axially opposite second end of the archery release, the first caliper including a recess;

the second caliper extends from the first end portion to a second end portion, and the second end portion is received in the recess of the first caliper;

the trigger extends from the first caliper and through an opening in the second caliper;

the stop member extends from the third pivot axis extending through the opening in the second caliper to the second pivot axis, the trigger abutting the stop member when the trigger is in the raised position, the stop member resisting further movement of the second caliper past the raised position of the trigger, the second caliper is disposed between the second pivot axis and the first caliper when the trigger is in the raised position;

the first caliper is disposed in the path of pivotal movement of the trigger from the raised position to the lowered position of the trigger, the first caliper engages the trigger when the trigger is in the lowered position, the first caliper resists further pivotal movement of the trigger past the lowered position of the trigger and thereby defines the lowered position of the trigger;

the first and second calipers are movable towards one another from the opened position to the closed position whereby an archer can squeeze the calipers together to manually move the calipers from the opened position to the closed position; and movement of the calipers from the opened position to the closed position causes the force generated by the first spring to move the trigger from the lowered position to the raised position as the calipers move from the opened position to the closed position and thereby enable the calipers to be locked in the closed position in response to the archer moving the calipers from the opened position to the closed position.

Feature 37. The archery release of feature 21 wherein the trigger is pivotally attached to the second caliper for pivotal movement about the second pivot axis and the one of the first and second calipers is the first caliper.

Feature 38. The archery release of feature 37 wherein the stop member extends from the first caliper and through an opening in the second caliper.

Feature 39. The archery release of feature 38 wherein the trigger extends from the second pivot axis out of the opening to the third pivot axis, the second caliper is between the third pivot axis and the first caliper and the trigger abuts the stop member in the opening when the trigger is in the raised position, the stop member resisting further movement of the second caliper past the raised position of the trigger.

Feature 40. The archery release of feature 37 wherein the first caliper is disposed in the path of pivotal movement of the stop member as the trigger is moved from the raised position to the lowered position of the trigger, the first caliper engaging the stop member when the trigger is in the lowered position, the first caliper thereby resisting further pivotal movement of the trigger past the lowered position of the trigger and thereby defining the lowered position of the trigger.

Feature 41. The archery release of feature 37 wherein when the calipers are in the closed position and the trigger is in the raised position, the stop member is in the path of pivotal movement of the second caliper away from the first caliper, the stop member being disposed to apply a force to the second caliper resisting further pivotal movement of the second caliper away from the first caliper.

Feature 42. The archery release of feature 37 wherein the first and second calipers are movable towards one another from the opened position to the closed position whereby an archer can squeeze the calipers together to manually move the calipers from the opened position to the closed position.

Feature 43. The archery release of feature 37 including a first spring being disposed to generate a force directly applied to the stop member and urging the trigger towards the raised position of the trigger;

wherein movement of the calipers from the opened position to the closed position causes the force generated by the spring to move the trigger from the lowered position to the raised position as the calipers move from the opened position to the closed position and thereby enabling the calipers to be locked in the closed position in response to the archer moving the calipers from the opened position to the closed position.

Feature 44. The archery release of feature 43 including a spring generating a force applied by the spring directly to the trigger, the force urging the trigger towards the raised position.

Feature 45. The archery release of feature 37 including a spring disposed between the first and second calipers, the second spring is disposed to generate a force transmitted to the calipers urging pivotal movement of the first and second calipers towards the opened position of the calipers.

Feature 46. The archery release of feature 45 wherein the spring is disposed between the first pivot axis and the first end portions of the calipers.

Feature 47. The archery release of feature 37 including a first spring, a second spring, a first end, and an opposite second end;

the first and second calipers as a unit are not disposed in a body and are not partially disposed in a body;

the first spring is a torsion spring disposed to generate a torque applied directly by the first spring to the stop member and transferred by the stop member to the trigger and thereby urging the trigger towards the raised position of the trigger;

the second spring is a compression spring disposed between the first and second calipers and is disposed to generate a force transmitted to the calipers urging pivotal movement of the first and second calipers towards the opened position of the calipers;

the first end portions of the calipers are disposed at the first end of the archery release and the first caliper extends from the first end of the archery release to the second end of the archery release, the first pivot axis is disposed between the first and second ends of the archery release, and the second pivot axis is disposed between the first end of the archery release and the first pivot axis;

the first caliper extends from the first end of the archery release to an axially opposite second end of the archery release, the first caliper including a recess;

the second caliper extends from the first end portion to a second end portion, and the second end portion is received in the recess of the first caliper;

the stop member extends from the first caliper and through an opening in the second caliper;

the trigger extends from the second pivot axis out of the opening to the third pivot axis, the second caliper is between the third pivot axis and the first caliper and the trigger abuts the stop member in the opening when the trigger is in the raised position, the stop member resisting further movement of the second caliper past the raised position of the trigger the first caliper is disposed in the path of pivotal movement of the stop member as the trigger is moved from the raised position to the lowered position of the trigger, the first caliper engaging the stop member when the trigger is in the lowered position whereby the first caliper resists further pivotal movement of the trigger past the lowered position of the trigger and thereby defining the lowered position of the trigger;

the first and second calipers are movable towards one another from the opened position to the closed position whereby an archer can squeeze the calipers together to manually move the calipers from the opened position to the closed position; and movement of the calipers from the opened position to the closed position causes the force generated by the first spring to move the trigger from the lowered position to the raised position as the calipers move from the opened position to the closed position and thereby enable the calipers to be locked in the closed position in response to the archer moving the calipers from the opened position to the closed position.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art including (but not limited to) changes in material selection, size, operating ranges (maximum relative displacement of the calipers or the like), caliper surface configurations or coatings, the design of the link mechanisms and the number of links, as well as such changes and alterations that fall within the purview of the following claims.

What is claimed is:

1. An archery release comprising:

a first caliper comprising an end portion;

a second caliper comprising an end portion;

the first and second calipers being pivotally mounted for relative pivotal movement of the calipers towards and away from each other about a common first pivot axis, the calipers being pivotally movable towards one another to a closed position of the calipers wherein the first and second caliper end portions are adjacent one another, and the calipers being pivotally movable away from one another from the closed position to an opened position of the calipers wherein the first and second caliper end portions are spaced apart from one another and define a gap therebetween;

a trigger pivotally mounted to one of the first and second calipers, the trigger being movable to and from a raised position and a lowered position pivotally spaced from the raised position;

a stop member being connected to the trigger, the stop member being conjointly movable with the trigger moving between the raised and lowered positions of the trigger;

wherein when the calipers are in the closed position and the trigger is in the raised position, the stop member is in the path of pivotal movement of the second caliper away from the first caliper and the stop member being disposed to generate a force applied to the second caliper resisting further pivotal movement of the second caliper away from the first caliper; and wherein when the calipers are in the opened position and the trigger is sin the lowered position, the stop member is in the path of pivotal movement of the second caliper away from the first caliper and the stop member being disposed to generate a force applied to the second caliper resisting further pivotal movement of the second caliper away from the first caliper.

2. The archery release of claim 1 comprising a first spring being disposed to generate a force being transmitted to the trigger urging the trigger towards the raised position of the trigger, and a second spring] being disposed between the first and second calipers, the second spring being disposed to generate a force transmitted to the calipers urging pivotal movement of the first and second calipers towards the opened position of the calipers.

3. The archery release of claim 1 comprising a first end and an axially opposite second end, the first end portions of the calipers being disposed at the first end of the archery release and at least one of the calipers extending continuously from the first end of the archery release to the second end of the archery release.

4. The archery release of claim 1 comprising a spring being disposed to generate a force transmitted to the trigger urging the trigger towards the raised position of the trigger;

the first and second calipers are movable towards one another from the opened position to the closed position whereby an archer can squeeze the calipers together to manually move the calipers from the opened position to the closed position; and movement of the calipers from the opened position to the closed position causes the force generated by the spring to move the trigger from the lowered position to the raised position as the calipers move from the opened position to the closed position, thereby enabling the calipers to be locked in the closed position in response to the archer moving the calipers from the opened position to the locked position.

5. The archery release of claim 1 wherein the first and second calipers as a unit are not housed within a body and are not housed partially within a body.

6. The archery release of claim 1 wherein the end portions of the calipers are disposed at a first end of the archery release, and the trigger pivots about a second pivot axis, the second pivot axis being disposed between the front end of the archery release and the first pivot axis.

7. The archery release of claim 1 wherein when the calipers are in the closed position, the calipers remain in the closed position without the need to apply pressure to the trigger.

8. The archery release of claim 1 wherein the stop member forms a portion of the trigger, the trigger being pivotally mounted to the first caliper for pivotal movement of the trigger between the raised and lowered positions of the trigger.

9. The archery release of claim 8 wherein the trigger extends from the first caliper and through an opening in the second caliper.

10. The archery release of claim 9 comprising a body mounted in the opening and attached to the second caliper, the body abutting the stop member when the calipers are in the opened position and the trigger is in the lowered position to resist further movement of the second caliper away from the first caliper.

11. The archery release of claim 10 wherein the stop member comprises spaced apart first and second surfaces, when the calipers are in the opened position and the trigger is in the lowered position the body abuts the first surface to resist further movement of the second caliper away from the first caliper, and when the calipers are in the closed position and the trigger is in the raised position the body abuts the second surface to resist further movement of the second caliper away from the first caliper.

12. The archery release of claim 8 wherein the first caliper is disposed in the path of pivotal movement of the trigger from the raised position to the lowered position of the trigger, the first caliper engaging the trigger when the trigger is in the lowered position, the first caliper resisting further pivotal movement of the trigger past the lowered position of the trigger and thereby defining the lowered position of the trigger.

13. The archery release of claim 8 comprising a spring being disposed to generate a force transmitted to the trigger urging the trigger towards the raised position of the trigger;

the first and second calipers are movable towards one another from the opened position to the closed position whereby an archer can squeeze the calipers together to manually move the calipers from the opened position to the closed position; and movement of the calipers from the opened position to the closed position causes the force generated by the spring to move the trigger from the lowered position to the raised position as the calipers move from the opened position to the closed position and thereby enabling the calipers to be locked in the closed position in response to the archer moving the calipers from the opened position to the closed position.

14. The archery release of claim 8 comprising a spring disposed between the first and second calipers, the second spring being disposed to generate a force transmitted to the calipers urging pivotal movement of the first and second calipers towards the opened position of the calipers; and the spring is disposed between the first pivot axis and the first end portions of the calipers.

15. The archery release of claim 8 comprising a first spring, a second spring, a roller, a first end, and an opposite second end;

the first and second calipers as a unit are not disposed in a body and are not partially disposed in a body;

the first spring is a torsion spring disposed to generate a torque applied directly by the first spring to the trigger urging the trigger towards the raised position of the trigger;

the second spring is a compression spring disposed between the first and second calipers and is disposed to generate a force transmitted to the calipers urging pivotal movement of the first and second calipers towards the opened position of the calipers;

the first end portions of the calipers are disposed at the first end of the archery release and the first caliper extends from the first end of the archery release to the second end of the archery release, the first pivot axis is disposed between the first and second ends of the archery release, and the second pivot axis is disposed between the first end of the archery release and the first pivot axis;

the first caliper extends from the first end of the archery release to an axially opposite second end of the archery release, the first caliper comprising a recess;

the second caliper extends from the first end portion to a second end portion, and the second end portion is received in the recess of the first caliper;

the trigger extends from the first caliper and through an opening in the second caliper, the roller is rotatably attached to the second caliper and is disposed in the opening;

the stop member comprises spaced apart first and second surfaces, when the calipers are in the opened position and the trigger is in the lowered position the roller abuts the first surface to resist further movement of the second caliper away from the first caliper, and when the calipers are in the closed position and the trigger is in the raised position the roller abuts the second surface to resist further movement of the second caliper away from the first caliper;

the first caliper is disposed in the path of pivotal movement of the trigger from the raised position to the lowered position of the trigger, the first caliper engaging the trigger when the trigger is in the lowered position, the first caliper resisting further pivotal movement of the trigger past the lowered position of the trigger and thereby defining the lowered position of the trigger;

the first and second calipers are movable towards one another from the opened position to the closed position whereby an archer can squeeze the calipers together to manually move the calipers from the opened position to the closed position; and movement of the calipers from the opened position to the closed position causes the force generated by the first spring to move the trigger from the lowered position to the raised position as the calipers move from the opened position to the closed position and thereby enabling the calipers to be locked in the closed position in response to the archer moving the calipers from the opened position to the closed position.

16. The archery release of claim 1 wherein the stop member and the trigger are separate members, the stop member being pivotally attached to the trigger for relative pivotal movement of the stop member with respect to the trigger about a second pivot axis and the stop member being pivotally attached to one of the first and second calipers for relative pivotal movement of the stop member with respect to the one of the first and second calipers about a third pivot axis.

17. The archery release of claim 16 wherein when the calipers are in the opened position and the trigger is in the lowered position the second caliper is disposed between the second pivot axis and the first caliper, and when the calipers are in the closed position and the trigger is in the lowered position the second caliper is disposed between the second pivot axis and the first caliper.

18. The archery release of claim 16 wherein the trigger is pivotally attached to the first caliper for pivotal movement about the second pivot axis and the one of the first and second calipers is the second caliper whereby the stop element is pivotally attached to the trigger and to the second caliper.

19. The archery release of claim 18 wherein the trigger extends from the first caliper and through an opening in the second caliper.

20. The archery release of claim 19 wherein the stop member extends from the third pivot axis out of the opening to the second pivot axis, the second caliper is disposed between the second pivot axis and the first caliper and the trigger abutting the stop member when the trigger is in the raised position, the stop member resisting further movement of the second caliper past the raised position of the trigger.

21. The archery release of claim 18 wherein the first caliper is disposed in the path of pivotal movement of the trigger from the raised position to the lowered position of the trigger, the first caliper engaging the trigger when the trigger is in the lowered position, the first caliper resisting further pivotal movement of the trigger past the lowered position of the trigger and thereby defining the lowered position of the trigger.

22. The archery release of claim 18 comprising a spring being disposed to generate a force transmitted to the trigger urging the trigger towards the raised position of the trigger;

the first and second calipers are movable towards one another from the opened position to the closed position whereby an archer can squeeze the calipers together to manually move the calipers from the opened position to the closed position; and movement of the calipers from the opened position to the closed position causes the force generated by the spring to move the trigger from the lowered position to the raised position as the calipers move from the opened position to the closed position and thereby enabling the calipers to be locked in the closed position in response to the archer moving the calipers from the opened position to the closed position.

23. The archery release of claim 18 comprising a spring being disposed to generate a force transmitted to the trigger urging the trigger towards the raised position of the trigger, and the spring is disposed between the first pivot axis and the first end portions of the calipers.

24. The archery release of claim 18 comprising a first spring, a second spring, a first end, and an opposite second end;

the first and second calipers as a unit are not disposed in a body and are not partially disposed in a body;

the first spring is a torsion spring disposed to generate a torque applied directly by the first spring to the trigger urging the trigger towards the raised position of the trigger;

the second spring is a compression spring disposed between the first and second calipers and is disposed to generate a force transmitted to the calipers urging pivotal movement of the first and second calipers towards the opened position of the calipers;

the first end portions of the calipers are disposed at the first end of the archery release and the first caliper extends from the first end of the archery release to the second end of the archery release, the first pivot axis is disposed between the first and second ends of the archery release, and the second pivot axis is disposed between the first end of the archery release and the first pivot axis;

the first caliper extends from the first end of the archery release to an axially opposite second end of the archery release, the first caliper comprising a recess;

the second caliper extends from the first end portion to a second end portion, and the second end portion is received in the recess of the first caliper;

the trigger extends from the first caliper and through an opening in the second caliper;

the stop member extends from the third pivot axis extending through the opening in the second caliper to the second pivot axis, the trigger abutting the stop member when the trigger is in the raised position, the stop member resisting further movement of the second caliper past the raised position of the trigger, the second caliper is disposed between the second pivot axis and the first caliper when the trigger is in the raised position;

the first caliper is disposed in the path of pivotal movement of the trigger from the raised position to the lowered position of the trigger, the first caliper engages the trigger when the trigger is in the lowered position, the first caliper resists further pivotal movement of the trigger past the lowered position of the trigger and thereby defines the lowered position of the trigger;

the first and second calipers are movable towards one another from the opened position to the closed position whereby an archer can squeeze the calipers together to manually move the calipers from the opened position to the closed position; and movement of the calipers from the opened position to the closed position causes the force generated by the first spring to move the trigger from the lowered position to the raised position as the calipers move from the opened position to the closed position and thereby enable the calipers to be locked in the closed position in response to the archer moving the calipers from the opened position to the closed position.

25. The archery release of claim 16 wherein the trigger is pivotally attached to the second caliper for pivotal movement about the second pivot axis and the one of the first and second calipers is the first caliper.

26. The archery release of claim 25 wherein the stop member extends from the first caliper and through an opening in the second caliper.

27. The archery release of claim 26 wherein the trigger extends from the second pivot axis out of the opening to the third pivot axis, the second caliper is between the third pivot axis and the first caliper and the trigger abuts the stop member in the opening when the trigger is in the raised position, the stop member resisting further movement of the second caliper past the raised position of the trigger.

28. The archery release of claim 25 wherein the first caliper is disposed in the path of pivotal movement of the stop member as the trigger is moved from the raised position to the lowered position of the trigger, the first caliper engaging the stop member when the trigger is in the lowered position, the first caliper thereby resisting further pivotal movement of the trigger past the lowered position of the trigger and thereby defining the lowered position of the trigger.

29. The archery release of claim 25 comprising a spring being disposed to generate a force transmitted to the trigger urging the trigger towards the raised position of the trigger;

the first and second calipers are movable towards one another from the opened position to the closed position whereby an archer can squeeze the calipers together to manually move the calipers from the opened position to the closed position; and movement of the calipers from the opened position to the closed position causes the force generated by the spring to move the trigger from the lowered position to the raised position as the calipers move from the opened position to the closed position and thereby enabling the calipers to be locked in the closed position in response to the archer moving the calipers from the opened position to the closed position.

30. The archery release of claim 25 comprising a spring disposed between the first and second calipers, the spring is disposed to generate a force transmitted to the calipers urging pivotal movement of the first and second calipers towards the opened position of the calipers, and the spring is disposed between the first pivot axis and the first end portions of the calipers.

31. The archery release of claim 25 comprising a first spring, a second spring, a first end, and an opposite second end;

the first and second calipers as a unit are not disposed in a body and are not partially disposed in a body;

the first spring is a torsion spring disposed to generate a torque applied directly by the first spring to the stop member and transferred by the stop member to the trigger and thereby urging the trigger towards the raised position of the trigger;

the second spring is a compression spring disposed between the first and second calipers and is disposed to generate a force transmitted to the calipers urging pivotal movement of the first and second calipers towards the opened position of the calipers;

the first end portions of the calipers are disposed at the first end of the archery release and the first caliper extends from the first end of the archery release to the second end of the archery release, the first pivot axis is disposed between the first and second ends of the archery release, and the second pivot axis is disposed between the first end of the archery release and the first pivot axis;

the first caliper extends from the first end of the archery release to an axially opposite second end of the archery release, the first caliper comprising a recess;

the second caliper extends from the first end portion to a second end portion, and the second end portion is received in the recess of the first caliper;

the stop member extends from the first caliper and through an opening in the second caliper;

the trigger extends from the second pivot axis out of the opening to the third pivot axis, the second caliper is between the third pivot axis and the first caliper and the trigger abuts the stop member in the opening when the trigger is in the raised position, the stop member resisting further movement of the second caliper past the raised position of the trigger the first caliper is disposed in the path of pivotal movement of the stop member as the trigger is moved from the raised position to the lowered position of the trigger, the first caliper engaging the stop member when the trigger is in the lowered position whereby the first caliper resists further pivotal movement of the trigger past the lowered position of the trigger and thereby defining the lowered position of the trigger;

the first and second calipers are movable towards one another from the opened position to the closed position whereby an archer can squeeze the calipers together to manually move the calipers from the opened position to the closed position; and movement of the calipers from the opened position to the closed position causes the force generated by the first spring to move the trigger from the lowered position to the raised position as the calipers move from the opened position to the closed position and thereby enable the calipers to be locked in the closed position in response to the archer moving the calipers from the opened position to the closed position.

* * * * *